US010702026B2

(12) United States Patent
Gray et al.

(10) Patent No.: US 10,702,026 B2
(45) **Date of Patent: *Jul. 7, 2020**

(54) SILICONE CLIP

(71) Applicant: Pandora A/S, København V (DK)

(72) Inventors: Lee Antony Gray, København Ø (DK); John Richard Decker, South Holland, IL (US)

(73) Assignee: Pandora A/S (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/745,662

(22) PCT Filed: Jul. 18, 2016

(86) PCT No.: PCT/EP2016/067062

§ 371 (c)(1),
(2) Date: Jan. 17, 2018

(87) PCT Pub. No.: WO2017/013067

PCT Pub. Date: Jan. 26, 2017

(65) Prior Publication Data

US 2018/0213893 A1 Aug. 2, 2018

(30) Foreign Application Priority Data

Jul. 17, 2015 (EP) ..... 15177386
Dec. 22, 2015 (EP) ..... 15202040

(51) Int. Cl.
*A44B 13/02* (2006.01)
*A44C 1/00* (2006.01)
(Continued)

(52) U.S. Cl.
CPC ..... *A44B 13/02* (2013.01); *A44C 1/00* (2013.01); *A44C 5/18* (2013.01); *A44C 15/005* (2013.01); *A44D 2201/00* (2013.01)

(58) Field of Classification Search
CPC ..... A44C 13/00; A44C 15/00; A44C 17/0208; A44C 25/00; A44C 25/007; A44C 13/02;
(Continued)

(56) References Cited

U.S. PATENT DOCUMENTS 1,240,043 A 9/1917 Gregory et al.
3,181,217 A 5/1965 Bohlinger et al.
(Continued)

FOREIGN PATENT DOCUMENTS

CN 204969817 U 1/2016
DE 370792 C 3/1923
(Continued)

*Primary Examiner* — Jack W Lavinder
(74) *Attorney, Agent, or Firm* — Condo Roccia Koptiw LLP

(57) ABSTRACT

Disclosed is a clip for a bracelet and/or a necklace. The clip in a closed state having a through hole (402) allowing the clip to wreathe an elongated member of a bracelet and/or necklace. The clip comprises: a first part (420) and a second part (430), the first and second parts being connected by a hinge (401); and a first resilient element (460) arranged in the second part. The first resilient element comprising a first gripping surface (451) for frictionally gripping a surface of the elongated member. The second part comprises a cavity (443) extending in the radial direction, the first resilient element comprises a first resilient part (460) arranged inside the cavity and a second resilient part (470) arranged outside the cavity and extending in the radial direction from the cavity into the through hole. The cavity is configured to secure the first resilient element in said second part.

20 Claims, 16 Drawing Sheets

(51) Int. Cl.
*A44C 5/18* (2006.01)
*A44C 15/00* (2006.01)

(58) Field of Classification Search
CPC ..... A44C 5/18; A44C 15/005; A44C 1/00; A44D 2201/00
USPC ..... 63/21, 23, 29.1, 38; 132/278, 279
See application file for complete search history.

(56) References Cited

U.S. PATENT DOCUMENTS

| | | | |
|---|---|---|---|
| 3,590,830 | A | 7/1971 | Hannum et al. |
| 4,237,702 | A | 12/1980 | Caverly et al. |
| 4,426,804 | A | 1/1984 | Hutson et al. |
| 4,554,934 | A | 11/1985 | Mooneyhan et al. |
| 4,754,534 | A | 7/1988 | Helwick |
| 5,082,011 | A | 1/1992 | Wu et al. |
| 5,396,912 | A | 3/1995 | Chou |
| 5,477,870 | A | 12/1995 | Menaged et al. |
| 5,996,593 | A | 12/1999 | Horman et al. |
| 6,311,699 | B1 | 11/2001 | Horman |
| 6,439,242 | B1 | 8/2002 | Head et al. |
| 7,007,507 | B2 | 3/2006 | Enevoldsen |
| 8,105,088 | B2 | 1/2012 | Charles et al. |
| 2002/0148250 | A1 | 10/2002 | Pratt et al. |
| 2003/0154742 | A1 | 8/2003 | Ooide et al. |
| 2004/0144131 | A1 | 7/2004 | Enevoldsen et al. |
| 2006/0260300 | A1 | 11/2006 | Julkowski et al. |
| 2007/0251268 | A1 | 11/2007 | Gisser et al. |
| 2008/0282599 | A1 | 11/2008 | Kavanaugh |
| 2009/0141866 | A1 | 6/2009 | Fenske et al. |
| 2009/0162816 | A1 | 6/2009 | Charle |
| 2012/0234045 | A1 | 9/2012 | Heiden et al. |
| 2013/0340764 | A1 | 12/2013 | Atkinson et al. |

FOREIGN PATENT DOCUMENTS

| | | | |
|---|---|---|---|
| DE | 1016053 | B | 9/1957 |
| FR | 1566678 | A | 5/1969 |
| GB | 2170682 | A | 8/1986 |
| WO | WO 2001/039627 | A1 | 6/2001 |
| WO | WO 2006/125155 | A1 | 11/2006 |
| WO | WO 2010/037183 | A1 | 4/2010 |

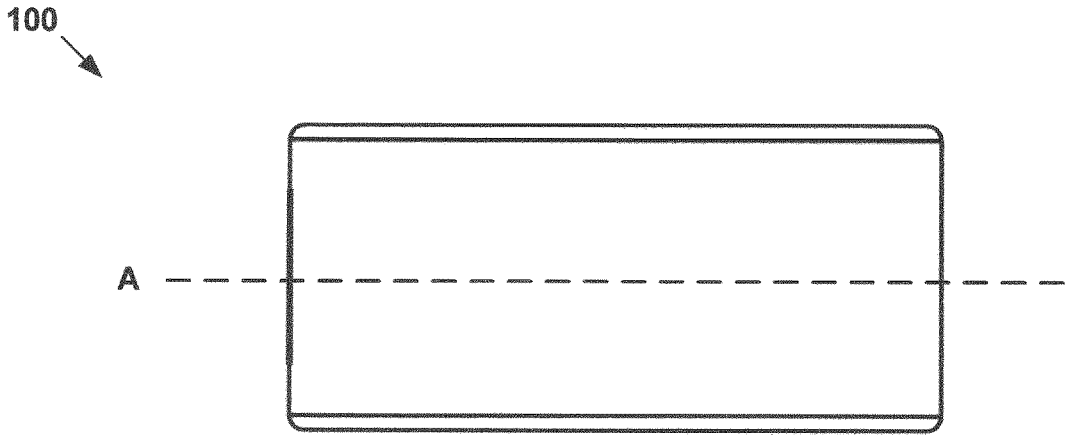
Fig. 1C
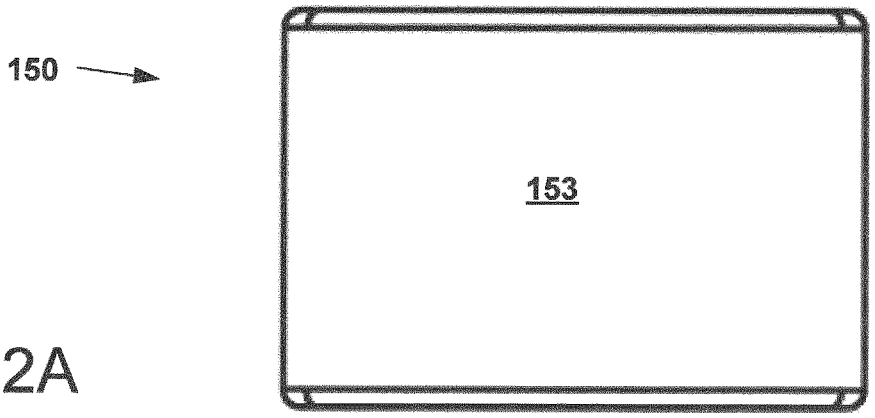
Fig. 2A
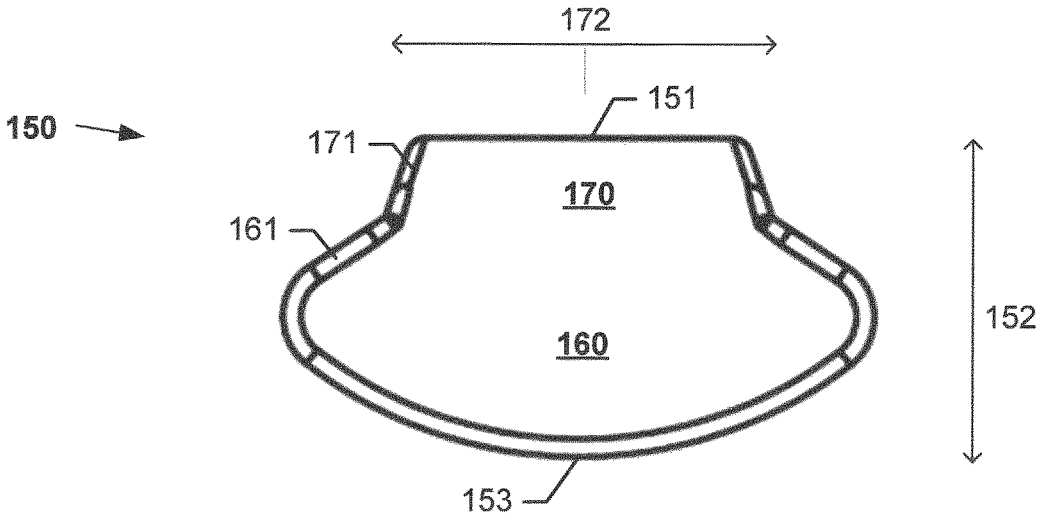
Fig. 2B
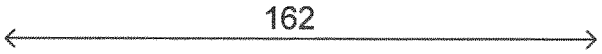

SILICONE CLIP

CROSS REFERENCE TO RELATED APPLICATIONS

This application is the National Stage Entry under 35 U.S.C. § 371 of Patent Cooperation Treaty Application No. PCT/EP/2016/067062, filed 18 Jul. 2016, which claims priority from European Patent Application No. 15177386.8, filed 17 Jul. 2015, and European Patent Application No. 15202040.0, filed 22 Dec. 2015, the contents of which are hereby incorporated by reference herein.

The present invention relates to a clip for a bracelet or a necklace, to a bracelet or a necklace comprising such a clip and a method for assembly of a clip.

Jewelry, such as necklaces and bracelets, often consists of a plurality of freely movable ornamental components, e.g. beads or charms strung on an elongated member, e.g. a chain, wire, or string. To prevent the freely movable beads from grouping together at the bottom of the necklace or bracelet or to group the freely movable beads in certain areas of the elongated member, an ornamental component provided with a stopping mechanism configured to grip the necklace or bracelet may be used. The ornamental component can be fixed or attached to the elongated member in one or more positions along the elongated member and has such dimensions that the freely movable beads are not able to move past the component. A variety of such ornamental components have been suggested in the prior art.

An example of a prior art variation of such an ornamental component is disclosed in Applicant's U.S. Pat. No. 7,007,507 in which a band fixed to the elongated member is configured to interact with an ornamental component to removably attach said component to the band. The band may comprise external threads interacting with external threads of the ornamental component. The ornamental component may be a clip with two parts hinged to each other. Since the band is fixed to the elongated member, it is not possible to freely adjust the position of the ornamental component, which may be desirable in some cases.

Resilient material such as silicone are commonly used for stopping mechanisms. The resilient material will deform when it comes into contact with a bracelet/necklace resulting in a spring force (attempting to restore the original shape of the stopping mechanism) that will releasably secure the ornamental component to a selected position of the bracelet/necklace.

WO 2006/125155 discloses an example of such an ornamental component, which uses a friction enhancing material positioned to abut the elongated member to achieve adjustable fixation of the ornamental component along the strand. The friction enhancing material, such as silicone rubber, covers all or a portion of the inside dimensions of an ornamental ring. The material is bonded or moulded onto the interior surface of the ring.

It may, however, be difficult to secure the resilient material to the ornamental component in a durable and easy manner.

Thus it remains a problem to provide a durable ornamental component that is easier manufacture.

According to a first aspect, the invention relates to a clip for a bracelet and/or a necklace, said clip in a closed state having a through hole allowing said clip to wreathe an elongated member of a bracelet and/or necklace, said through hole defining a through hole axis extending in an axial direction, with a radial direction extending radially from the axial direction; said clip comprising:

a first part and a second part, the first and second parts being connected by a hinge; and a first resilient element arranged in said second part, the first resilient element comprising a first gripping surface for frictionally gripping a surface of the elongated member;

wherein the second part comprises a cavity extending in the radial direction, the first resilient element comprises a first resilient part arranged inside said cavity and a second resilient part arranged outside said cavity and extending in the radial direction from said cavity into said through hole, wherein the cavity is configured to secure the first resilient element in said second part.

Consequently, the first resilient element may be secured to the second part in an easy and secure manner. This further allows the first resilient element to be secured to the second part without or with limited use of adhesives, thereby protecting the user from coming into contact with potential harmful chemicals and increasing the aesthetic value of the ornamental component.

A clip may be any component that can be clipped on a bracelet and/or necklace for ornamental purposes. A clip according to the first aspect of the invention may be used to organize freely movable beads on a bracelet or necklace, e.g. two clips may be arranged at desired position on an elongated member of a bracelet or necklace, whereby they resiliently grip the elongated member. Consequently, the bracelet or necklace is divided into three distinct zones for freely movable beads. This may be used to prevent all the freely movable beads from grouping together. The first part of the clip may comprise a second resilient element comprising a second gripping surface for frictionally gripping a surface of the elongated member, whereby the first resilient element and the second resilient element allows said clip to be releasably secured at selected positions along the elongated member. Alternatively, the first part of the clip may comprise a rigid second gripping surface, whereby the first resilient element and the rigid second gripping surface allows said clip to be releasably secured at selected positions along the elongated member.

In the context of the present specification the term "wreathe" is to be understood as meaning to cover, surround, or encircle.

In the context of the present specification the term "rigid" is to be understood as being substantially unable to bend or be forced out of shape during normal use.

In the context of the present specification the term "resilient" is to be understood as being able to recoil or spring back into shape after bending, stretching, or being compressed.

The first resilient element is an element that that is deformable under the influence of a particular force and capable of recoiling back into substantially its original shape once the particular force is removed.

The first resilient element will be somewhat compressed in the radial direction by the elongated member and vice versa will the first resilient element exert a force in the radial direction on the elongated member, so that the elongated member is pushed towards the rigid second gripping surface, thus creating tension between the rigid second surface and the elongated member, so that the clip is releasably secured on said elongated member.

The first resilient element may be made of a resilient material such as a silicone material including a silicone rubber. Preferably the first resilient element is manufactured from a material comprising at least 50, more preferred at least 80, more preferred at least 95 percent of, most preferred essentially consists of, a material or a combination of materials selected from the group consisting of silicone, silicone rubber, natural rubber, synthetic rubber, PTFE, polyethylene, polypropylene, HDPE, polystyrene and nylon. The first resilient element material may comprise additives and fillers, including colouring agents.

In some embodiments, the first resilient element is being spaced apart from the first part.

The first resilient element is spaced apart from the first part in a relaxed/uncompressed state and in a compressed state, when the clip is arranged on the elongated member. In the context of the present specification the term "spaced apart" is to be understood as being separated, having spaces between, not being in direct contact.

The first resilient element may be secured to the second part by any means such as by an adhesive or by griping means in the second part.

The clip may be forced to move along the elongated member, on which it is positioned by exerting a force in the axial direction, preferably using a hand.

The first and second parts of the clip may provide the primary structural strength of the clip. The clip may be made of metal, glass, wood, plastic, ceramics or a combination thereof. The first and second parts of the clip may be individually integrally moulded, i.e. made from a single mould.

The clip may have any outer shape such as round or rectangular. Correspondingly, the through hole of the clip in an assembled state may have any shape such as round or rectangular.

In some embodiments the cavity is shaped so as to grip the first resillent part and secure the first resilient element in said second part.

During manufacture of the clip the first resilient part of the first resilient element may thus be readily arranged in said cavity using the resilience of the material to compress it to fit through an opening of the cavity. When inserted into the cavity the first resilient part may again expand to fit into the cavity and be secured therein.

The cavity may have a depth dimension in the radial direction that is ⅕ to ⅘ of a largest total extent of the second part in the radial direction, preferably ¼ to ¾, more preferred approximately ½. In case of a clip with a circular shape the largest total extent of the second part in the radial direction corresponds to a diameter of the circle.

In some embodiments the first resilient part has a first outer surface and the second resilient part has a second outer surface, the first outer surface and the second outer surface extending at an angle with respect to each other.

Consequently, the second resilient part may extend into the through hole allowing the first gripping surface to grip the elongated member, when the clip is arranged on said elongated member.

In some embodiments the second part comprises a shell having an outer surface and an inner surface, the cavity comprises at least one side wall extending from the inner surface of the shell of the second part, the at least one side wall being configured to grip the first resilient part and secure the first resilient element in said second part.

In some embodiments the first resilient element defines a height extending in the radial direction and a width along a reference axis being perpendicular to the radial direction and the through hole axis, where the maximum width of the first resilient part is larger than the maximum width of the second resilient part.

Hereby the width of the first resilient part and the shape of the at least one side wall secures the first resilient element to the second part.

In some embodiments the second part comprises a shell having an outer surface and an inner surface, the cavity comprises two side walls extending from the inner surface of the shell of the second part, the two side walls being configured to grip the first resilient part and secure the first resilient element in said second part.

The first resilient element may substantially fit in the cavity in the direction of the through hole axis. The first resilient element may be slightly compressed within the cavity in the direction of the through hole axis. Thus any significant movement of the first resilient element inside the cavity in the direction of the through hole axis is prevented so that the first resilient element is held in the desired position.

In some embodiments an air filled cavity is formed between a bottom of the first resilient element and a bottom of the cavity at least when the first resilient element is in an un-compressed state, thereby allowing the resilient member to expand further into the cavity in response to a force exerted by an elongated member of a bracelet and/or necklace on the first gripping surface.

This may reduce the stress induced on the first resilient element during normal use. Furthermore, it may limit the expansion of the first resilient element in a direction along the through hole axis, thereby both securing that the first resilient element is kept within the protective first and second parts of the clip and prevent the first resilient element from being twisted out of the cavity.

In some embodiments the first gripping surface is a smooth, even surface.

In some embodiments the through hole comprises a first and a second, opposite opening with respect to the through hole axis. The through hole may have a constant width or may have a varying width (measured in planes being perpendicular to the through hole axis. e.g. the through hole may be wider at a central part than at the first and second openings of the through hole.

In some embodiments the first resilient element has a third resilient part, the third resilient part protruding from the first gripping surface, the third resilient part having a third gripping surface for gripping a surface of the elongated member, whereby the clip may be releasably secured to parts of the elongated member having different widths.

In some embodiments the first resilient element has a fourth resilient part, the fourth resilient part protruding from the first gripping surface, the fourth resilient part having a fourth gripping surface for gripping a surface of the elongated member.

By providing a first resilient element having the third and fourth resilient parts protruding from the first gripping surface, the clip may be positioned on parts of the elongated member having different widths, whilst still releasably securing the clip to the elongated member, i.e. the first gripping surface may enable the clip to grip around parts of the elongated having an extended width such as a band on the elongated member (as long as the length of the band is not larger than the distance between the third resilient part and the fourth resilient part), and the third and fourth gripping surface may grip around the remaining parts of the elongated member.

In some embodiments the first resilient element positioned in the second part, has a width along the through hole axis of less than 95%, 90%, 80%, 70%, 60% or 50% of the width of the second part along the through hole axis.

In some embodiments, the first resilient element is arranged with a distance to the first and second opening of the through hole of the clip.

In some embodiments, the first and/or second opening of the through hole of the clip have a shape and size substantially matching the shape and size of the part of the elongated member of the bracelet/necklace designated for receiving the clip, whereby at least a part of the surfaces surrounding the openings may function as blocking surfaces for preventing the clip from being moved over a part of the elongated member having an extended width.

In some embodiments the first part comprises a closing element for releasably securing the first and second part to each other in said closed state of the clip.

In some embodiments the closing element is arranged inside the clip, so that the clip encloses the closing element in said closed state of the clip. In some embodiments the closing element is a leaf spring arranged inside the first part, a part of the leaf spring extending out of the first part and in a closed state of the clip extending into the second part.

Consequently, a clip is provided that is exempt from having an external closing mechanism obstructing the aesthetic appearance of the clip, thus allowing a more freely design of the exterior surface of the clip.

In some embodiments the second part comprises a closing cavity for receiving the part of the leaf spring extending out of the first part and in a closed state of the clip extending into the second part.

In some embodiments the closing cavity comprises a closing protrusion, the closing cavity providing a releasable snap-lock with the part of the spring extending from the first part in a closed state of the clip.

In some embodiments the clip has a length along the through hole axis between 1 mm and 4 cm, between 2 mm and 2 cm, or between 2 mm and 1 cm.

In some embodiments, said clip further comprises a second resilient element arranged in said first part, the second resilient element comprising a second gripping surface for frictionally gripping a surface of the elongated member, wherein the first resilient element and the second resilient element allows said clip to be releasably secured at selected positions along the elongated member.

The second resilient element may be made of a material identical to or similar to the material of the first resilient element.

In some embodiments, the first part comprises a cavity extending in the radial direction, the second resilient element comprises a first resilient part arranged inside said cavity and a second resilient part arranged outside said cavity and extending in the radial direction from said cavity, wherein the cavity is configured to secure the second resilient element in said first part.

In some embodiments the cavity is shaped so as to grip the first resilient part and secure the second resilient element in said first part.

During manufacture of the clip the first resilient part of the second resilient element may thus be readily arranged in said cavity using the resilience of the material to compress it to fit through an opening of the cavity. When inserted into the cavity the second resilient part may again expand to fit into the cavity and be secured therein.

The cavity may have a depth dimension in the radial direction that is ⅕ to ⅘ of a largest total extent of the second part in the radial direction, preferably ¼ to ¾, more preferred approximately ½. In case of a clip with a circular shape the largest total extent of the second part in the radial direction corresponds to a diameter of the circle.

The second resilient element may substantially fit in the cavity of the first part in the direction of the through hole axis. The first resilient element may be slightly compressed within the cavity in the direction of the through hole axis. Thus any significant movement of the first resilient element inside the cavity in the direction of the through hole axis is prevented so that the first resilient element is held in the desired position.

In some embodiments an air filled cavity is formed between a bottom of the second resilient element and a bottom of the cavity at least when the second resilient element is in an un-compressed state, thereby allowing the second resilient member to expand further into the cavity in response to a force exerted by an elongated member of a bracelet and/or necklace on the second gripping surface.

This may reduce the stress induced on the second resilient element during normal use.

In some embodiments, the first part comprises a closing element for releasably securing the first and the second part to each other in said closed state of the clip, wherein the second gripping element is arranged on top of the closing element and at least partly secures the closing element to the first part.

In some embodiments, the width along the through hole axis of the first part of the second resilient element is larger than the width along the through hole axis of the second part of the second resilient element.

In some embodiments, the first part of the clip comprises two flanges extending along the through hole axis and being configured to grip the first part of the second resilient element and secure the second resilient element in said first part of the clip.

Consequently, the second resilient element may effectively be secured to the first part of clip, while still providing room for arranging a closing element in the first part of the clip.

In some embodiments, the second gripping surface is a smooth, even surface.

In some embodiments, the second resilient element has a third resilient part, the third resilient part protruding from the second gripping surface, the third resilient part having a fifth gripping surface for gripping a surface of the elongated member, whereby the clip may be releasably secured to parts of the elongated member having different widths.

In some embodiments, the second resilient element has a fourth resilient part, the fourth resilient part protruding from the second gripping surface, the fourth resilient part having a sixth gripping surface for gripping a surface of the elongated member.

In some embodiments, the first part comprises a rigid second gripping surface for gripping a surface of the elongated member, and the resilient element and the rigid second gripping surface allows said clip to be releasably secured at selected positions along the elongated member.

The rigid second gripping surface is a surface being substantially unable to bend or be forced out of shape during normal use. The rigid second gripping surface may be made of a rigid material such as silver or steel. The first part may have more than one rigid gripping surface e.g. the first part may have one rigid griping surface at the first opening of the through hole and one rigid gripping surface at the second opening of the through hole.

In some embodiments the rigid, second gripping surface of the first part has a shape that is substantially equal to an outer shape of the elongated member of the bracelet/necklace.

In some embodiments the rigid, second gripping surface is concave e.g. it has a semi-circular shape.

Hereby the second gripping surface may fit snugly around the elongated member with a substantially circular surface, providing a larger area of contact.

According to a second aspect, the invention relates to a bracelet or a necklace comprising:

an elongated member; and a clip as disclosed in relation to the first aspect of the invention configured to be releasably secured at selected positions along at least a part of the elongated member.

The elongated member may be any elongated member suitable for jewelry such as a metal chain, leather string, a fabric string, or any other type of chain.

In some embodiments, the bracelet or necklace further comprises at least one freely moveable ornamental component strung on said elongated member.

In some embodiments, the bracelet or necklace further comprises a plurality of freely moveable ornamental components strung on said elongated member.

In some embodiments the bracelet or necklace further comprises a second clip as disclosed in relation to the first aspect of the invention arranged on said elongated member, wherein the second clip is configured so that the first gripping surface and the second gripping surface resiliently grips the elongated member to allow said second clip to be releasably secured at selected positions along the elongated member until a particular force is acting on said second clip, whereby the second clip can be moved along the elongated member.

In some embodiments the bracelet or necklace further comprises a band fixed to the elongated member; the band having an extended width compared with the width of remaining parts of the elongated member, wherein the clip is configured so that the second gripping surface and the first gripping surface grips the band to allow said clip to be releasably attached to said band.

The band may be a band on bracelet as disclosed in U.S. Pat. No. 7,007,507. The bracelet may comprise at least two bands.

According to a third aspect, the invention relates to a method for assembly of a clip, said clip in a closed state having a through hole allowing said clip to wreathe an elongated member of a bracelet and/or necklace, said through hole defining a through hole axis extending in an axial direction, with a radial direction extending radially from the axial direction, comprising the steps of:

providing a first part and a second part of the clip, the first and second parts being connectable by a hinge, wherein the second part comprises a cavity extending in the radial direction;

providing a first resilient element comprising a first gripping surface for frictionally gripping a surface of the elongated member, a first resilient part and a second resilient part; and inserting the first resilient element in the cavity of said second part so that the first resilient part is arranged inside said cavity and the second resilient part is arranged outside said cavity and extends in the radial direction from said cavity into said through hole.

Consequently, an efficient method of assembling a clip is provided.

In some embodiments the clip is a clip as disclosed in relation to the first aspect of the invention.

The different aspects of the present invention can be implemented in different ways including as a clip, bracelets or necklaces comprising a clip, and methods of assembling a clip described above and in the following, each yielding one or more of the benefits and advantages described in connection with at least one of the aspects described above, and each having one or more preferred embodiments corresponding to the preferred embodiments described in connection with at least one of the aspects described above and/or disclosed in the dependant claims.

Furthermore, it will be appreciated that embodiments described in connection with one of the aspects described herein may equally be applied to the other aspects.

The above and/or additional objects, features and advantages of the present invention will be further elucidated by the following illustrative and non-limiting detailed description of embodiments of the present invention, with reference to the appended drawings, wherein:

FIGS. 1A-C show a clip according to a first embodiment of the present invention.

FIGS. 2A-C show a first resilient element for a clip according to the first embodiment of the present invention.

Figure 7A:
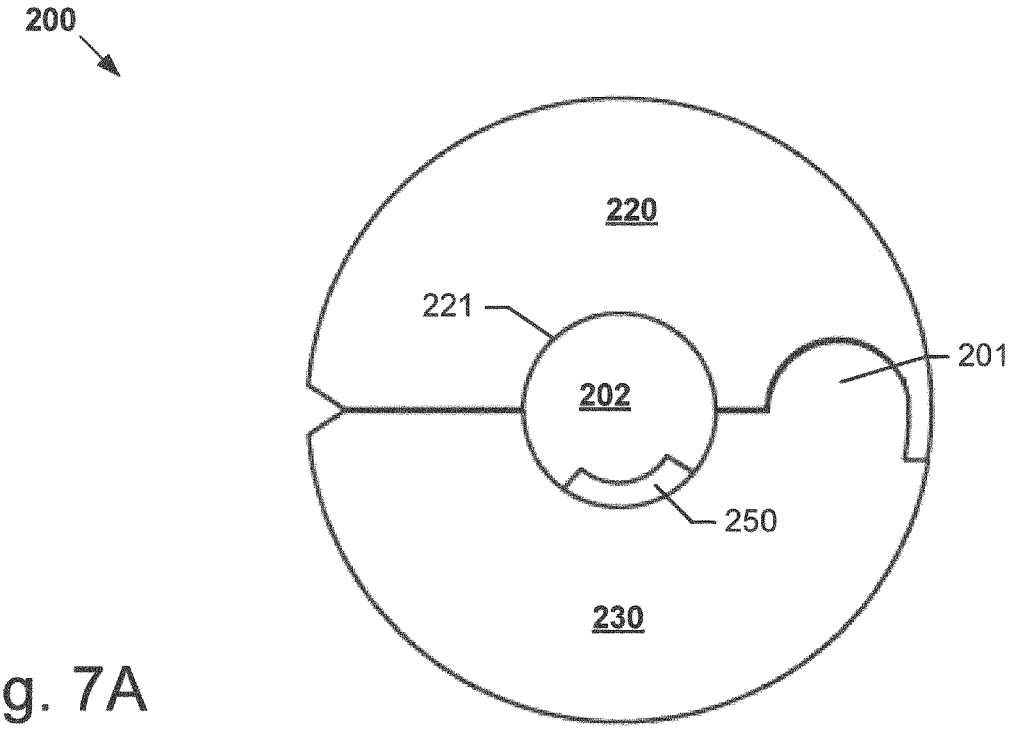
Figure 7B:
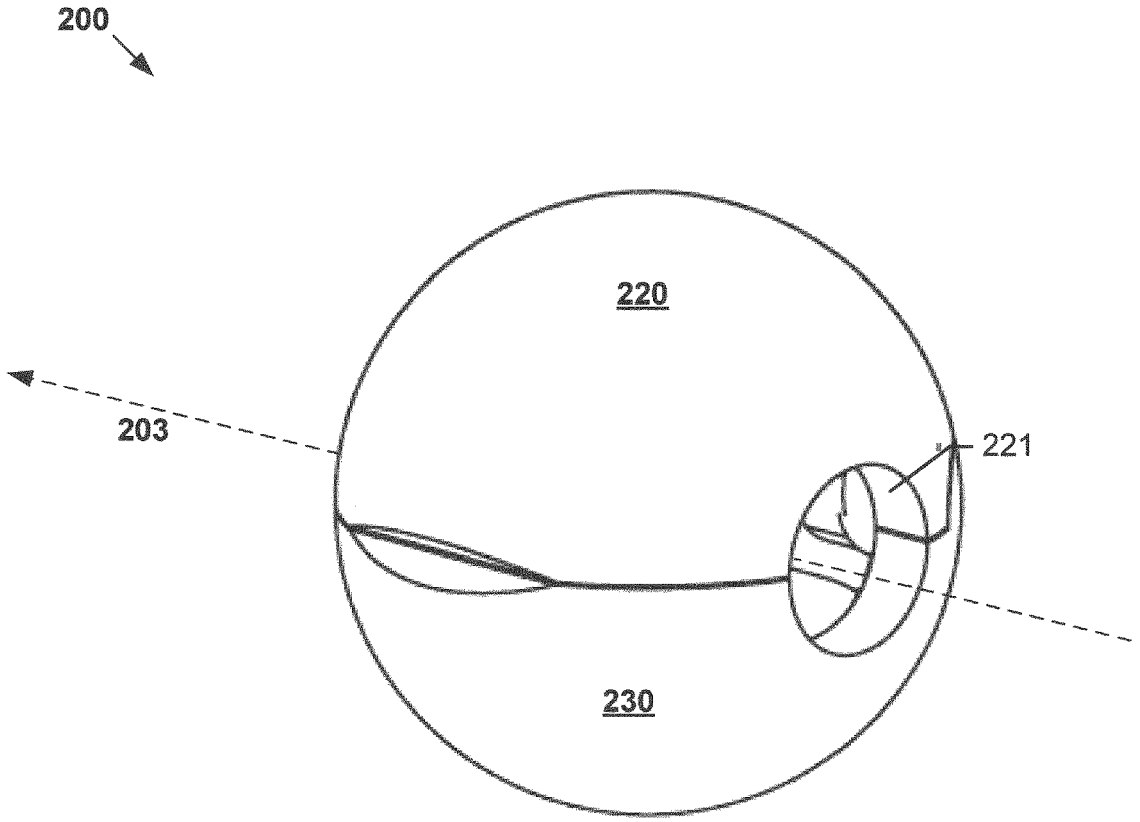
Figure 7C:
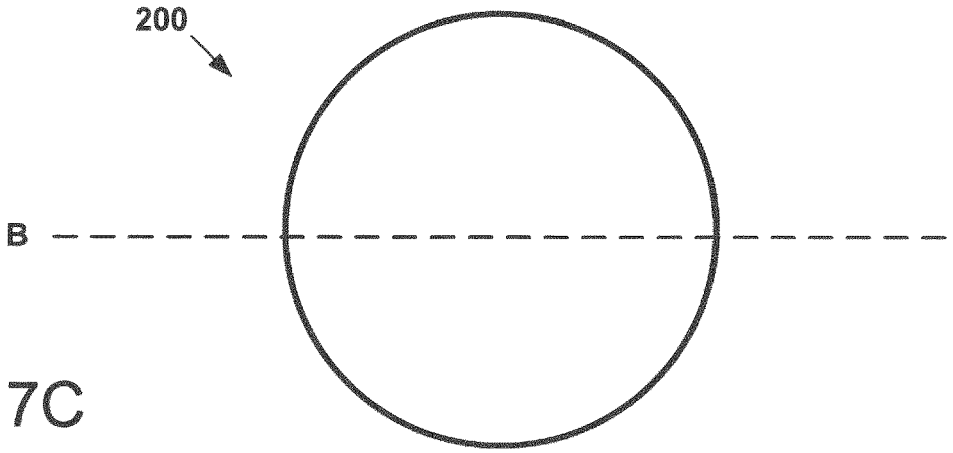

FIGS. 7A-C show a clip according to a second embodiment of the present invention.

FIGS. 8A-E show a first resilient element for a clip according to the second embodiment of the present invention.

Figure 9:
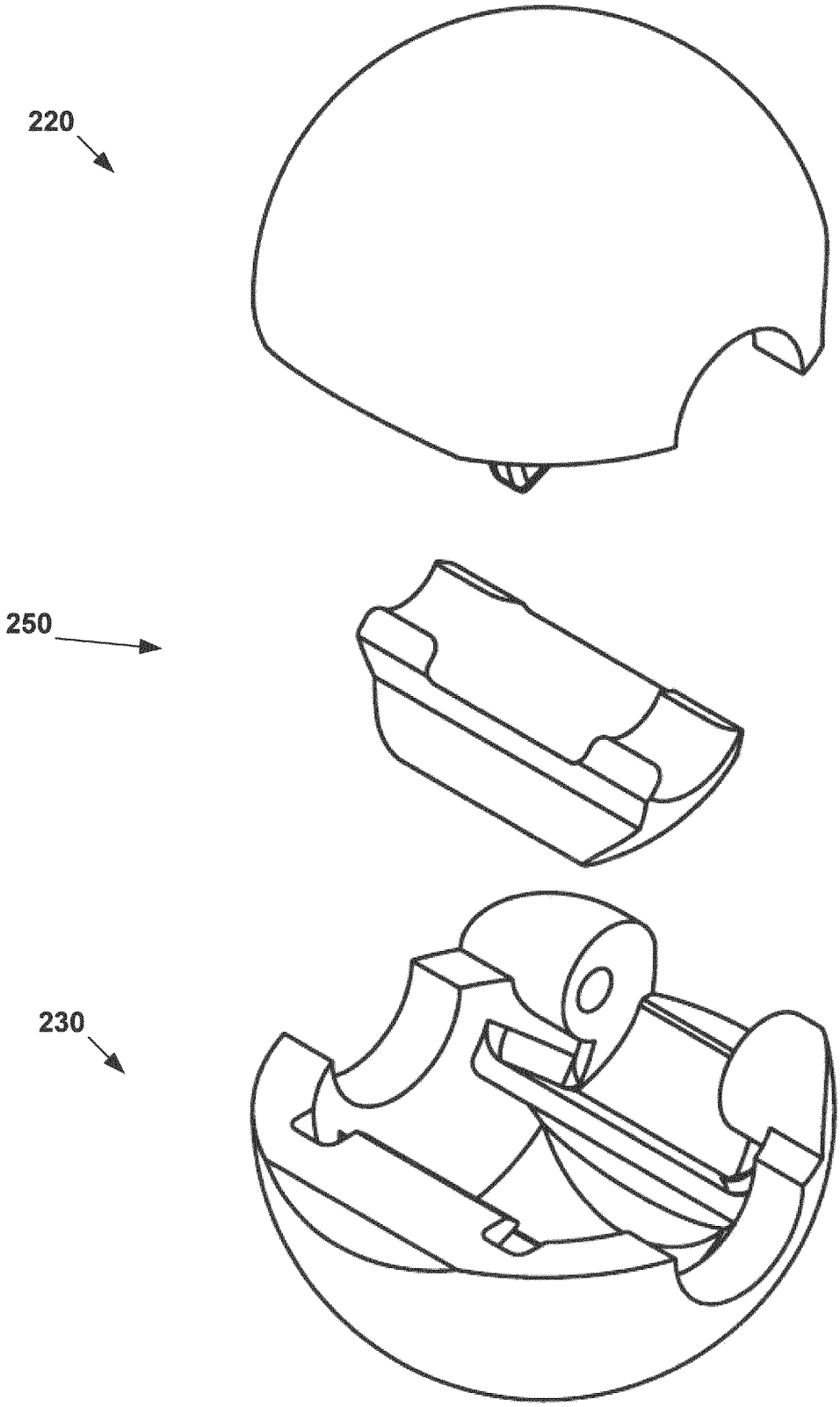

FIG. 9 shows an exploded view of a clip according to the second embodiment of the present invention.

Figure 10:
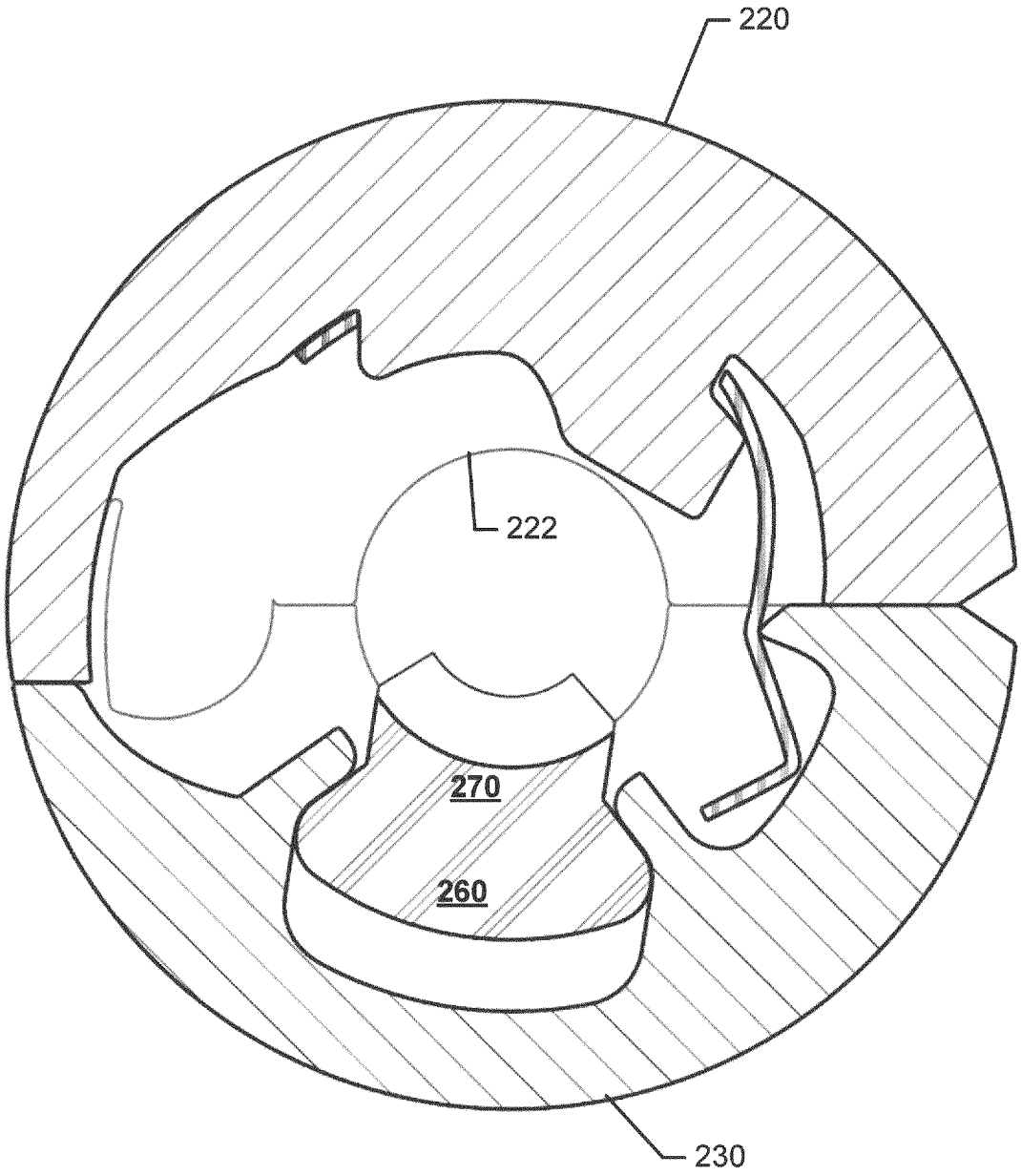

FIG. 10 shows a cross-section of a clip according to the second embodiment of the present invention.

Figure 11:
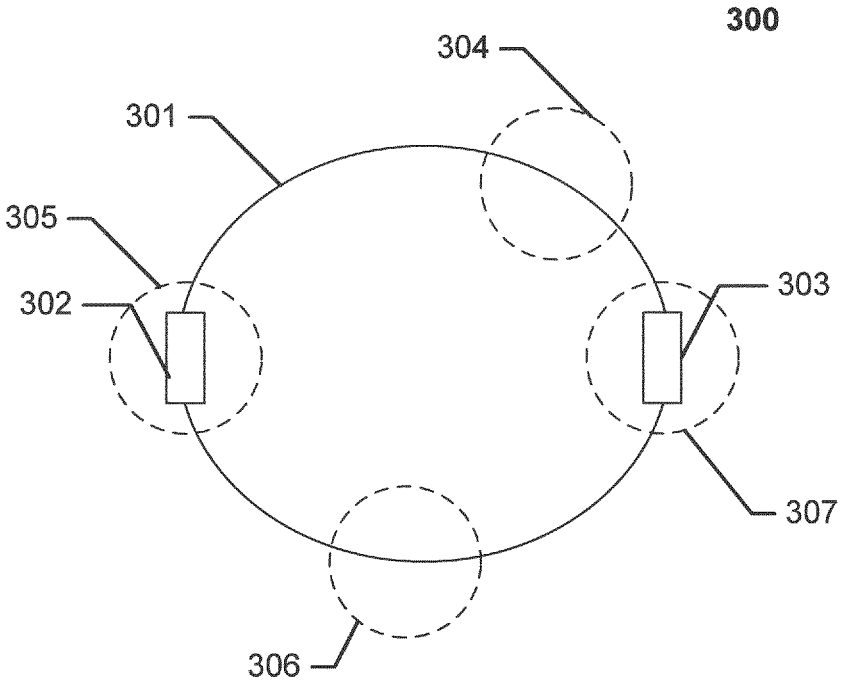

FIG. 11 shows schematically a bracelet/necklace comprising one or more clips according an embodiment of the invention.

Figure 12A:
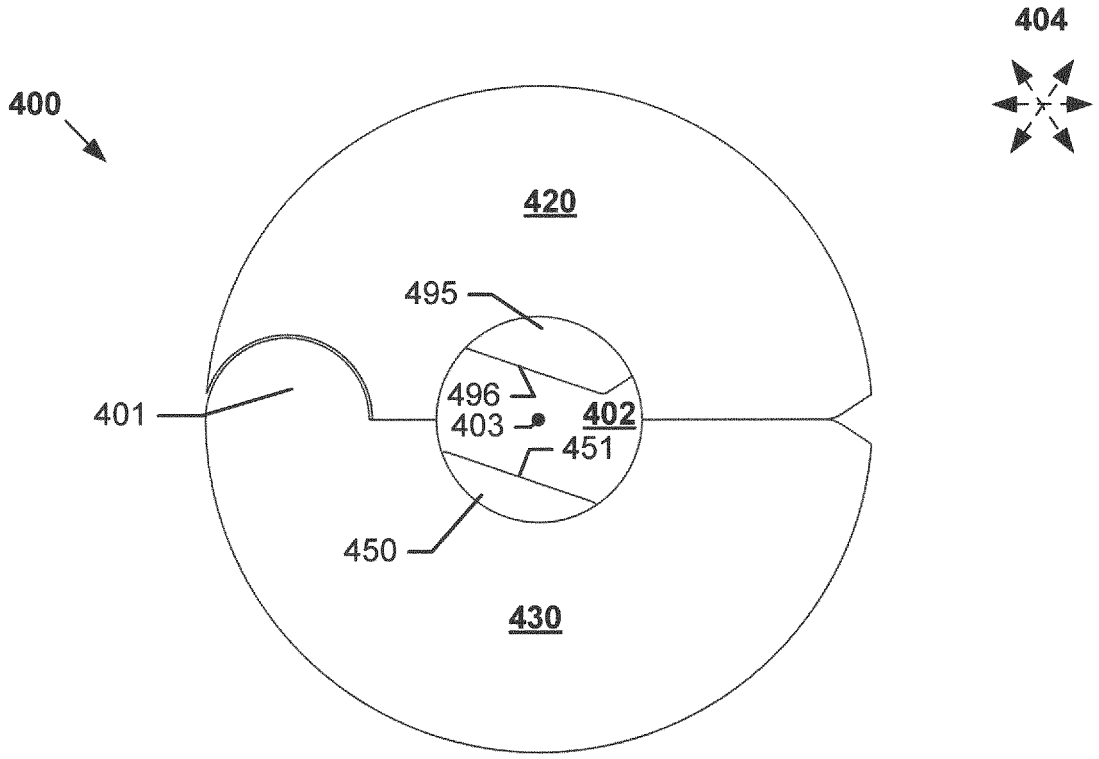
Figure 12B:
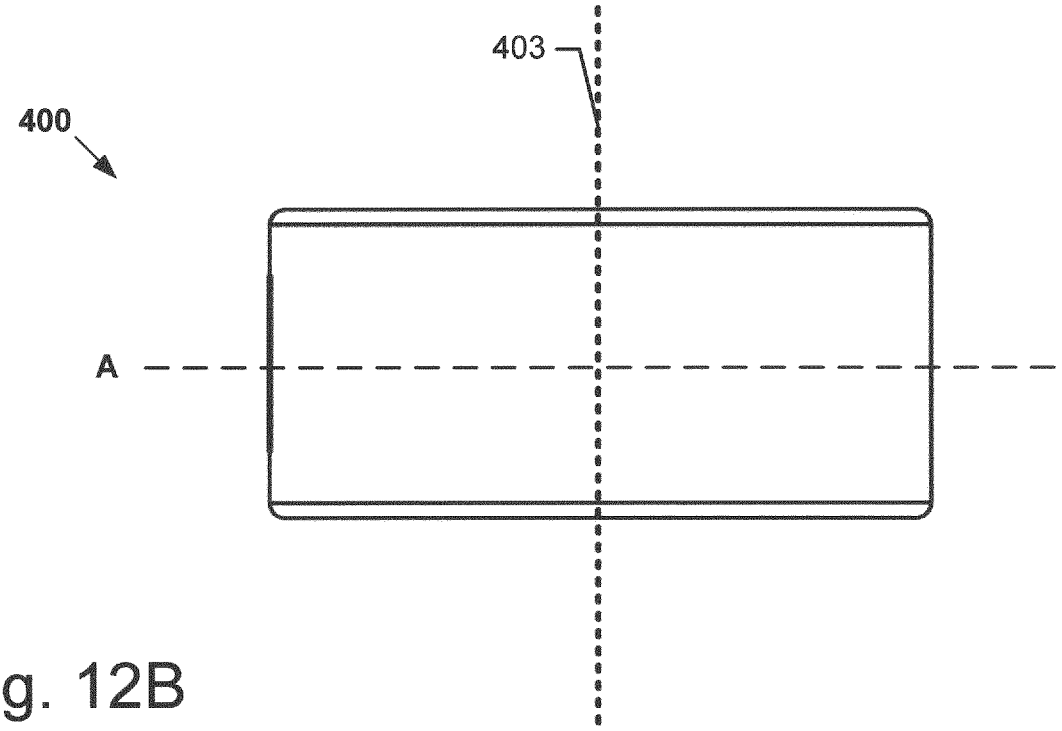

FIGS. 12A-B show a clip according to a third embodiment of the present invention.

Figure 13A:
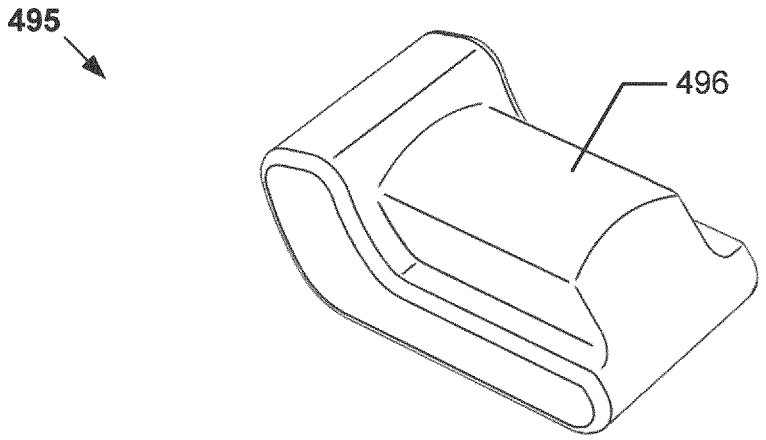
Figure 13B:
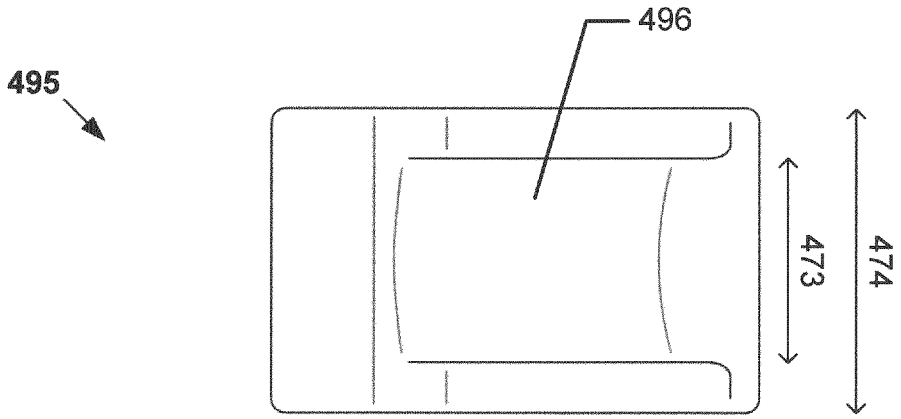
Figure 13C:
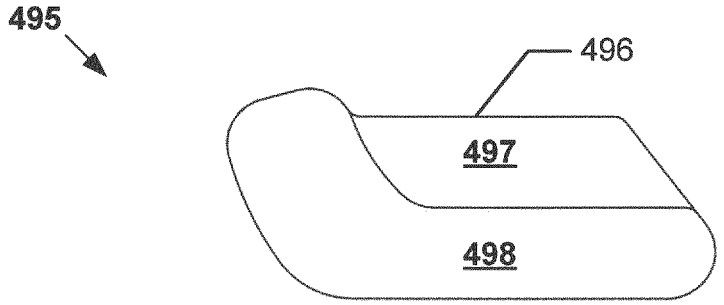

FIGS. 13A-C show a second resilient element for a clip according to the third embodiment of the present invention.

Figure 14A:
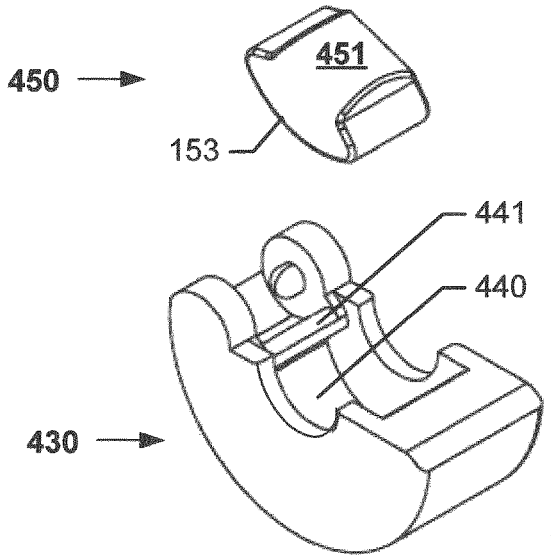

FIG. 14A shows an exploded view of a second part of a clip according to the third embodiment of the present invention.

Figure 14B:
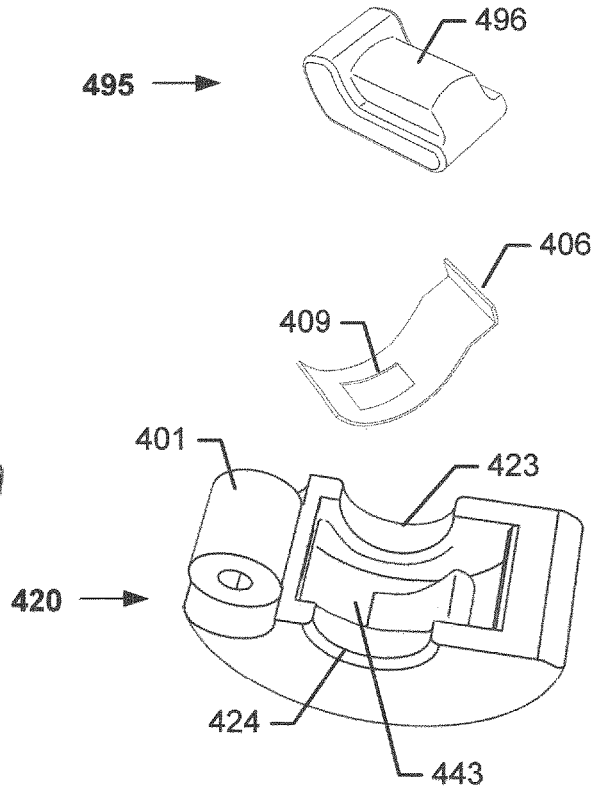

FIG. 14B shows an exploded view of a first part of a clip according to the third embodiment of the present invention.

Figure 14C:
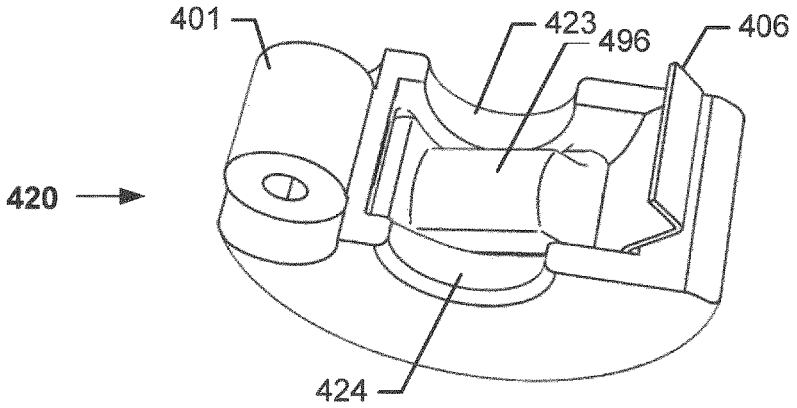

FIG. 14C shows a view of a second part of a clip according to the third embodiment of the present invention.

Figure 15:
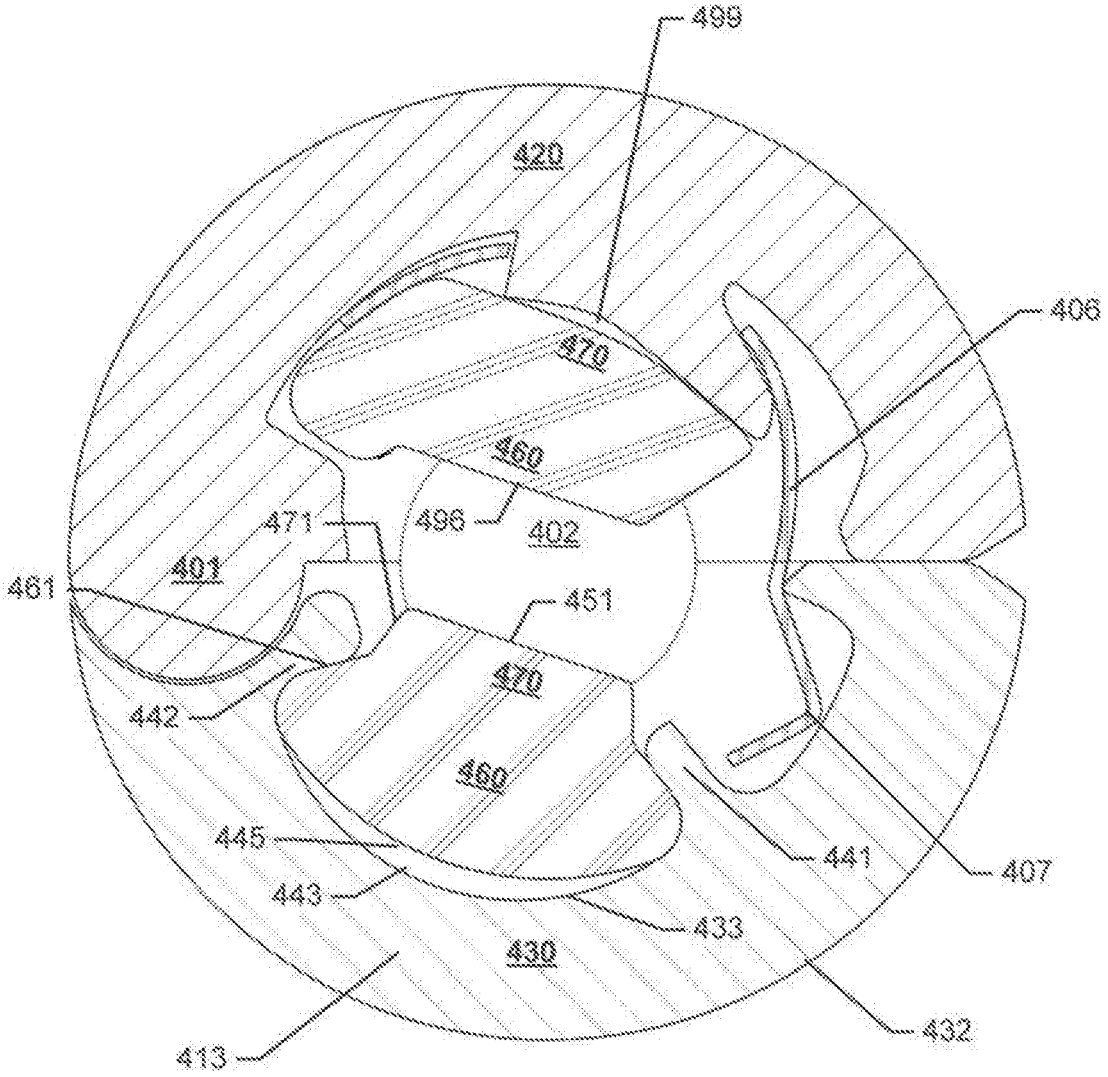

FIG. 15 shows a cross-section of a clip according to the third embodiment of the present invention.

In the following description, reference is made to the accompanying figures, which show by way of illustration how the invention may be practiced.

FIGS. 1-5 show a clip 100 according to a first embodiment of the present invention. FIG. 1A-C show the clip 100 assembled, where FIG. 1A shows a side view, FIG. 1B shows a perspective view, and FIG. 1C shows a top view.

Figure 1A:
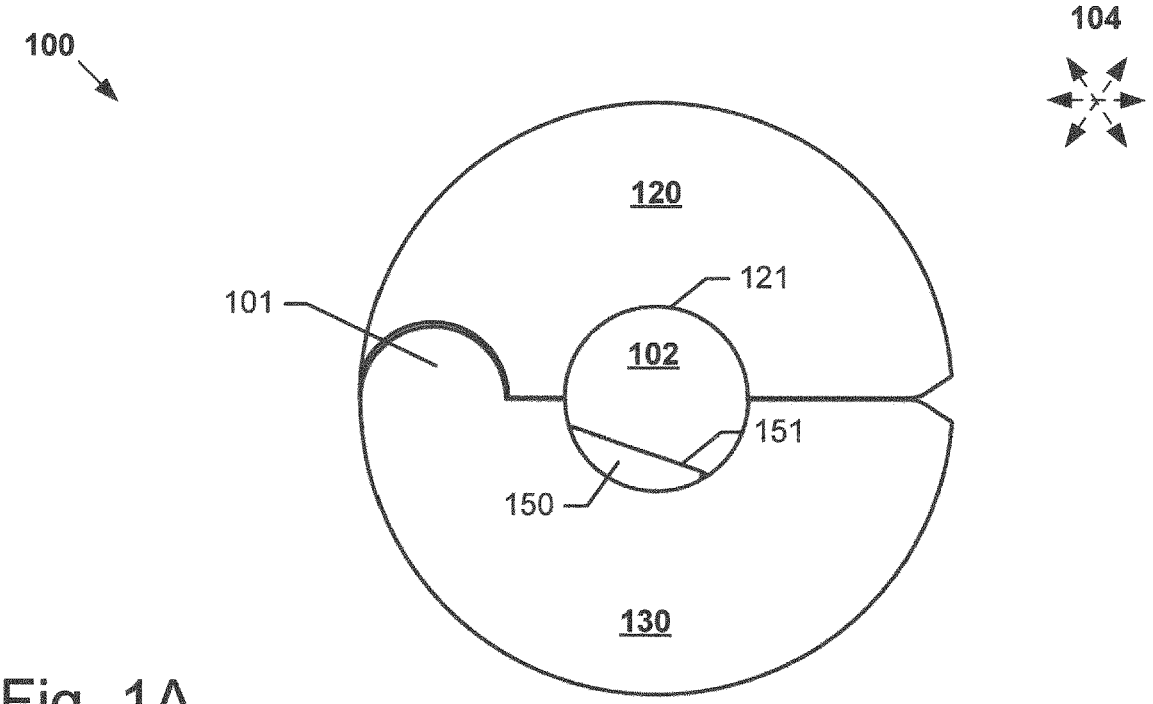
Figure 1B:
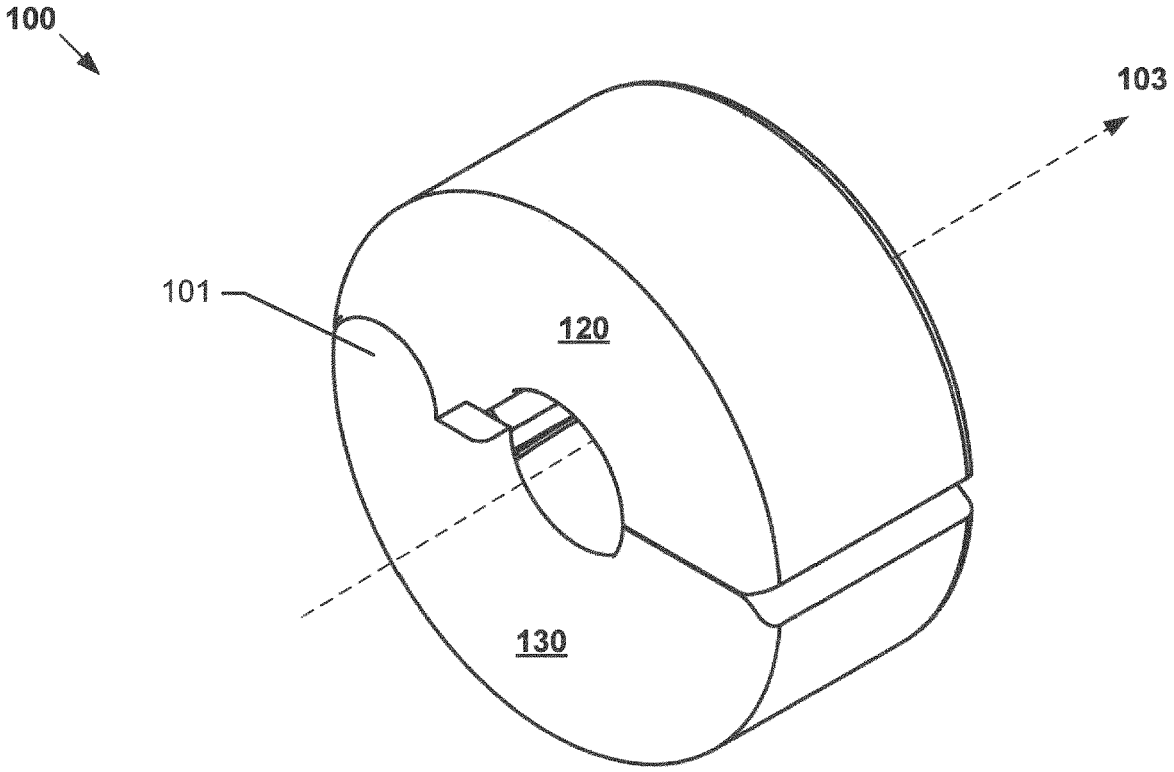
Figure 2C:
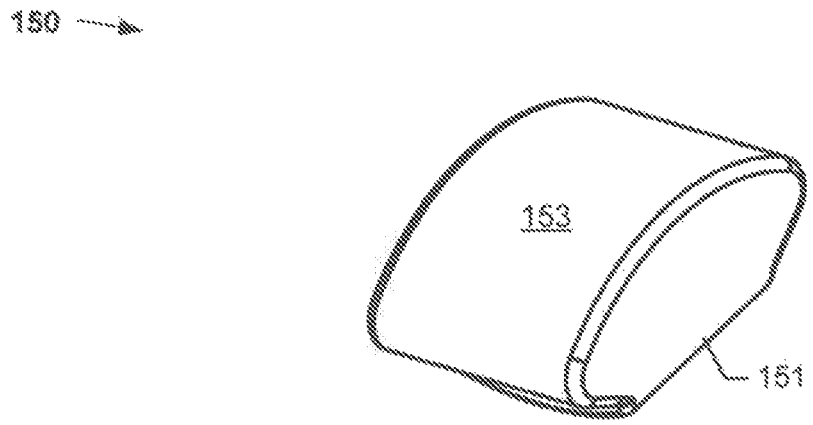

FIGS. 2A-C show a first resilient element 150 of the clip 100, where FIG. 2A shows a bottom view, FIG. 2B shows a side view, and FIG. 2C shows a perspective view.

Figure 3:
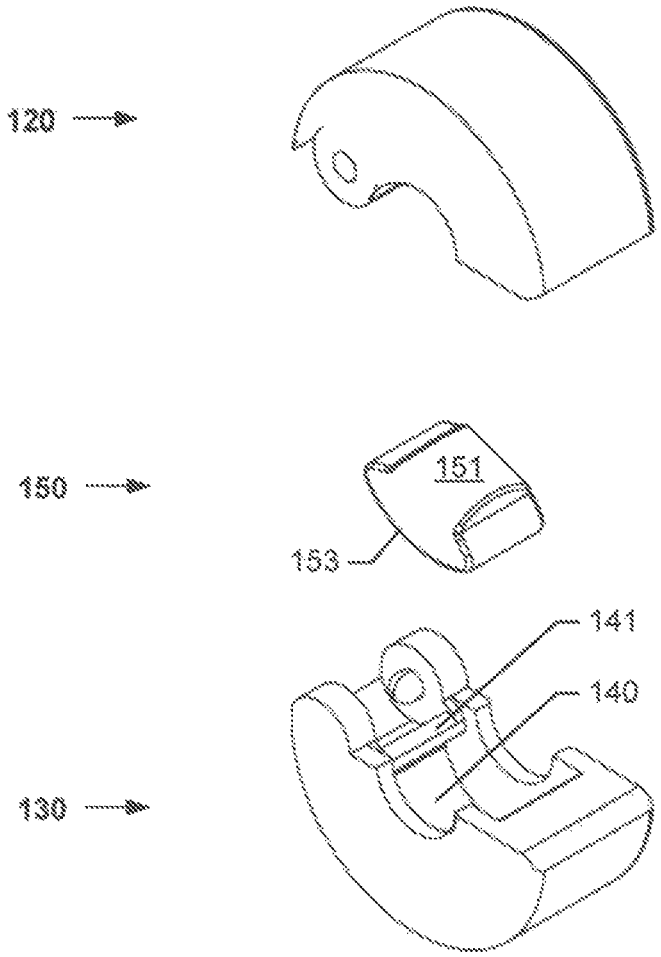
FIG. 3 shows an exploded view of a clip according to the first embodiment of the present invention.

FIG. 3 shows an exploded view of the clip 100.

Figure 4:
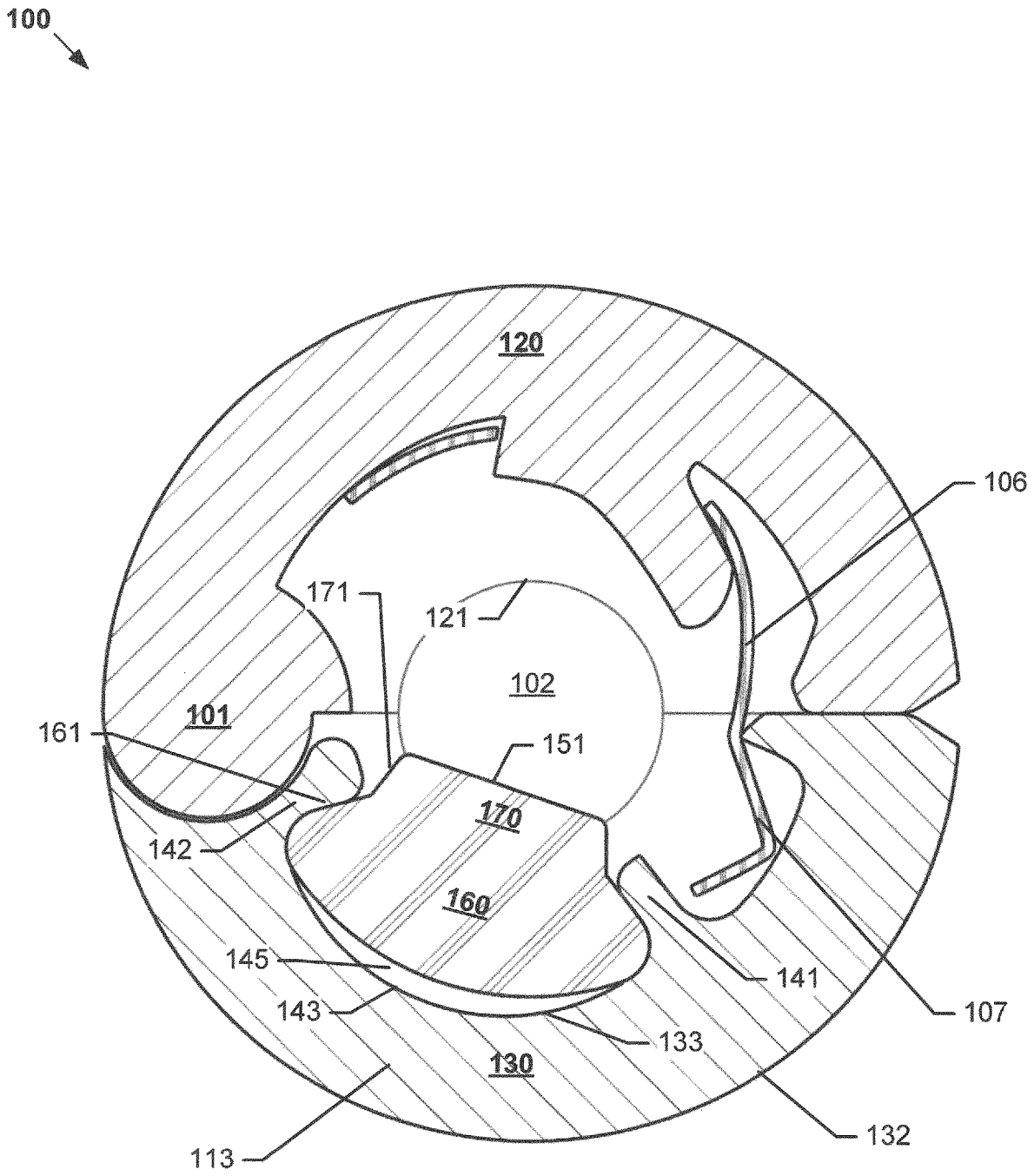
FIG. 4 shows a cross-section of a clip according to the first embodiment of the present invention.
Figure 5A:
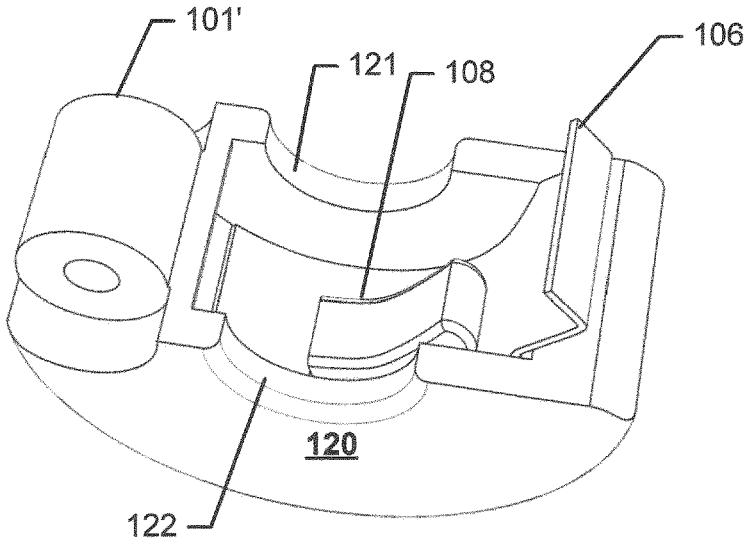
FIG. 5 shows a first part of a clip according to an embodiment of the invention.
Figure 5B:
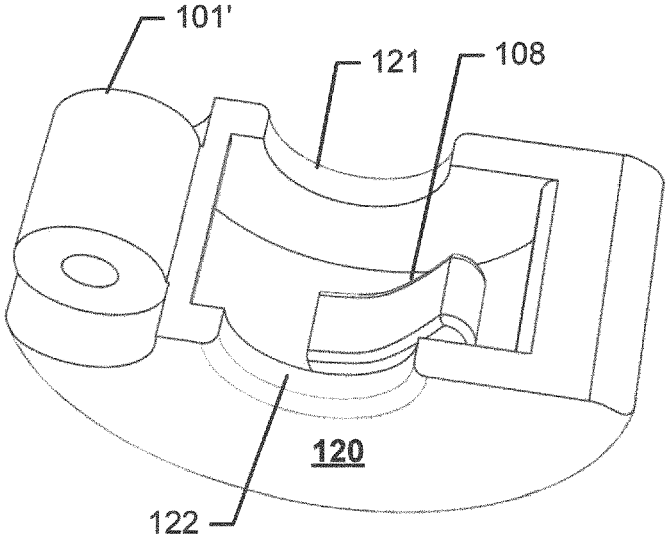
Figure 5C:
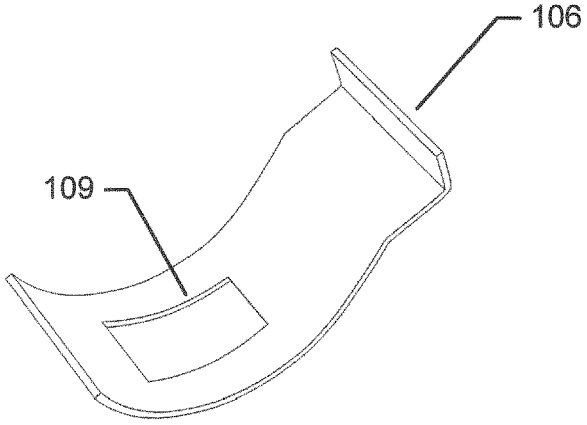

FIG. 4 shows a cross-section of the clip along the line A shown in FIG. 1C. FIG. 5A-B show perspective views of a first part of the clip 120, where FIG. 5A shows the first part 120 with a closing element 106 inserted, and FIG. 5B shows the first part 120 without the closing element. FIG. 5C shows the closing element.

In the following reference will be made to FIGS. 1-5.

Figure 6:
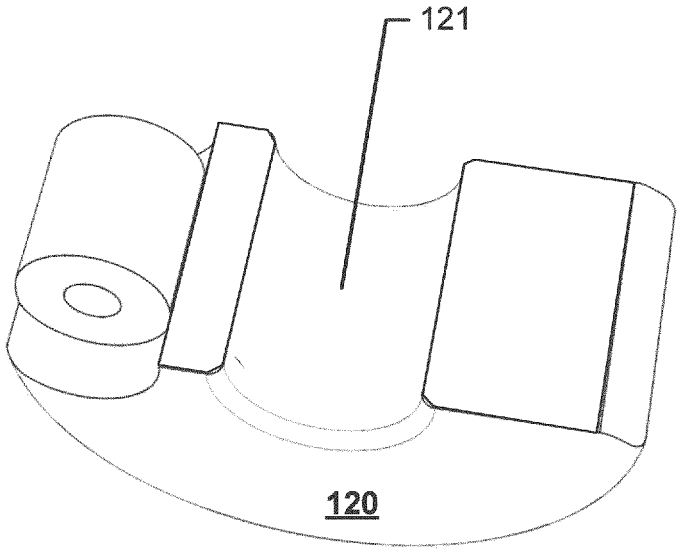
FIG. 6 shows a first part of a clip according to an embodiment of the invention.

The clip 100 is a clip for a bracelet and/or a necklace. The clip in a closed state (as shown in FIGS. 1 and 4) have a through hole 102 allowing the clip 100 to wreathe an elongated member (such as a chain) of a bracelet and/or necklace. The through hole 102 defining a through hole axis 103 extending in an axial direction, with a radial direction 104 extending radially from the axial direction. The clip 100 comprises a first part 120 and a second part 130, the first and second parts 120 130 being connected by a hinge 101. The clip 100 further comprise a first resilient element 150 arranged in the second part 130. The first resilient element 150 comprises a first gripping surface 151 for frictionally gripping a surface of the elongated member of a bracelet/necklace. The first resilient element 150 is spaced apart from the first part 120 i.e. the first resilient element 150 does not touch the first part 120. The first part 120 comprises two rigid gripping surfaces 121 122 for gripping a surface of the elongated member. In this embodiment two rigid gripping surfaces 121 122 are two ridges arranged at the first and second opening of the through hole 102 respectively. FIG. 6 shows an alternative design of the first element according to an embodiment of the present invention, where the first part 120 only is provided with a single rigid gripping surface 121.

The first resilient element 150 and the rigid gripping surfaces 121 122 allows the clip to be releasably secured at selected positions along the elongated member i.e. the first resilient element 150 and the rigid gripping surfaces 121 together grips the elongated member and secures the clip to the elongated member.

The clip may be forced to move along the elongated member, on which it is positioned by exerting a force in the axial direction, preferably using a hand.

In this embodiment the through hole is circular and the clip 100 have a cylindrical shape.

In this embodiment the two gripping surface 121 122 have a concave shape (in a plane being perpendicular to the through hole axis 103).

The first gripping surface 151 is a smooth even surface.

The through 102 hole may have a varying width (measured in planes being perpendicular to the through hole axis 103, i.e. the through hole is wider at a central part than at the first and second openings of the through hole 103.

The second part 130 comprises a cavity 140 extending in the radial direction 104, the first resilient element 150 comprises a first resilient part 160 arranged inside the cavity 140 and a second resilient part 170 arranged outside the cavity 140 and extending in the radial direction 104 from the cavity 140. The cavity 140 being configured to secure the first resilient element 150 in the second part 130.

Consequently, the first resilient element may be secured to the second part in an easy and secure manner. This further allows the first resilient element to be secured to the second part without the use of an adhesive, thereby protecting the user from coming into contact with potential harmful chemicals and increasing the aesthetic value of the ornamental component.

The cavity 140 is shaped so as to grip the first resilient part 160 and secure the first resilient element 150 in the second part 130.

The first resilient part 160 has a first outer surface 161 and the second resilient part 170 has a second outer surface 171, the first outer surface 161 and the second outer surface 171 extending at an angle with respect to each other.

The second part comprises a shell 131 having an outer surface 132 and an inner surface 133, the cavity 140 comprises a first side wall 141 and a second side wall 142 extending from the inner surface of the shell 133 of the second part 130, the first and second side wall 141 142 being configured to grip the first resilient part 160 and secure the first resilient element 150 in the second part 130 of the clip 100.

The first resilient element 150 has a height 152 extending in the radial direction and a width 172 162 along a reference axis being perpendicular to the radial direction and the through hole axis 103, where the maximum width 162 of the first resilient part 160 is larger than the maximum width 172 of the second resilient part 170.

Thus the width of the first resilient part 16 and the shape/orientation of the first and second side walls 141 142 secures the first resilient element 150 to the second part 130.

An air filled cavity 145 is formed between a bottom of the first resilient element 150 and a bottom of the cavity 140 at least when the first resilient element is in an un-compressed state, thereby allowing the resilient member 150 to expand further into the cavity 190 in response to a force exerted by an elongated member of a bracelet and/or necklace on the first gripping surface 451.

This may reduce the stress induced on the first resilient element 150 during normal use. Furthermore, it may limit the expansion of the first resilient element 150 in a direction along the through hole axis 103, thereby both securing that the first resilient element 150 is kept within the protective first and second parts 120 130 of the clip 100 and prevent the first resilient element 150 from being twisted out of the cavity 140. The first part 120 comprises a closing element 106 for releasably securing the first and second part to each other in the closed state of the clip 100.

The closing element 106 is arranged inside the clip 100, so that the clip encloses the closing element in said closed state of the clip.

The closing element 106 is a leaf spring arranged inside the first part 120, a part of the leaf spring extending out of the first part 120 and in a closed state of the clip extending into the second part 130.

The first part comprises a protruding member 108 for securing the closing element 106 to the first part 120, and the closing element 106 comprises an opening 109 for receiving the protruding member 108.

FIGS. 7-10 show a clip 200 according to a second embodiment of the present invention. FIG. 7A-C show the clip 200 assembled, where FIG. 7A shows a side view, FIG. 7B shows a perspective view, and FIG. 7C shows a top view.

Figure 8A:
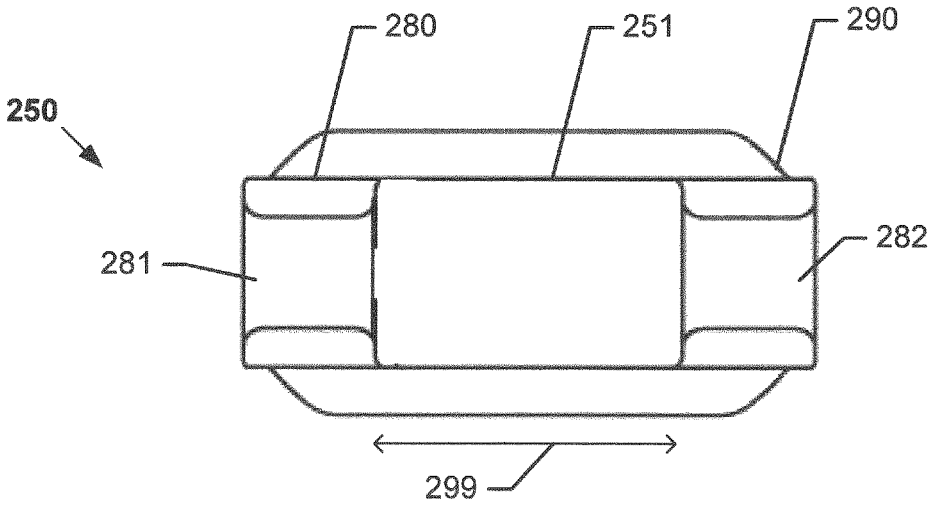
Figure 8B:
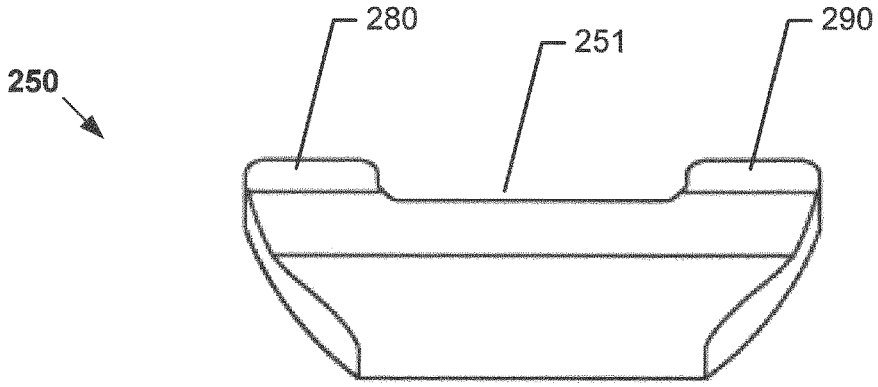
Figure 8C:
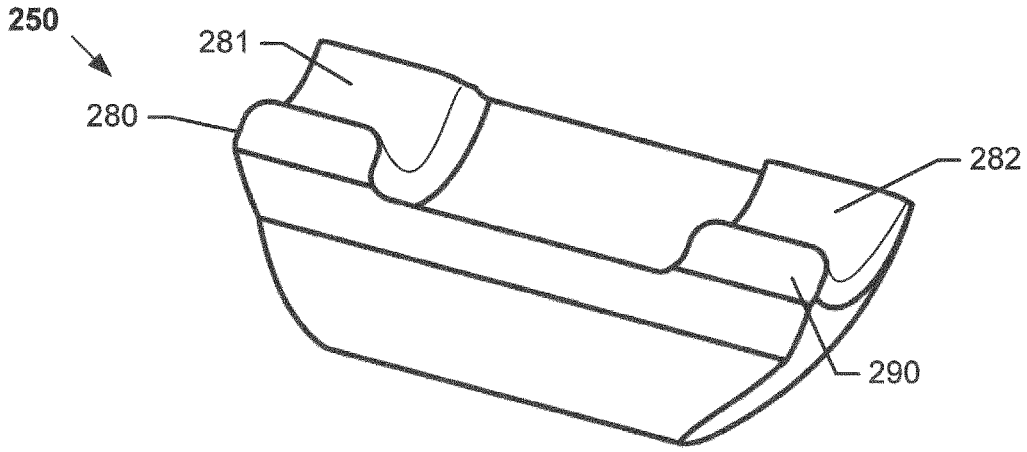
Figure 8D:
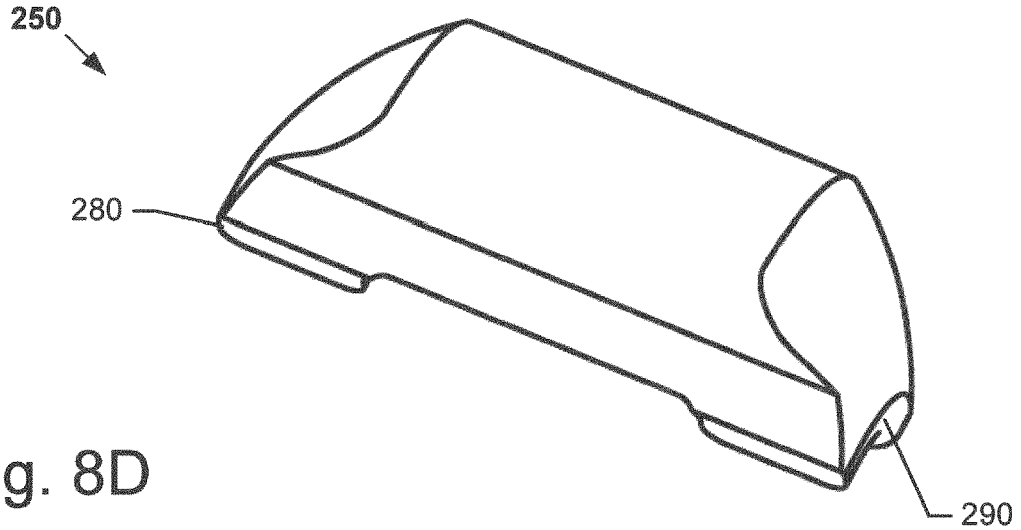
Figure 8E:
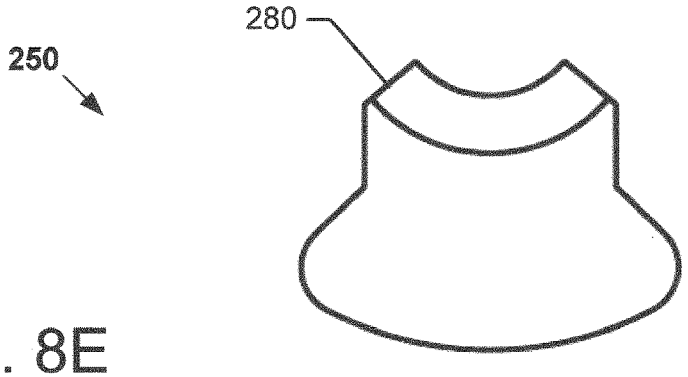

FIGS. 8A-E show a first resilient element 250 of the clip 200, where FIG. 8A shows a top view, FIG. 8B shows a side view, and FIG. 8C-D show perspective views, and FIG. 8*e* shows a front view.

FIG. 9 shows an exploded view of the clip 200.

FIG. 10 shows a cross-section of the clip 200 along the line B shown in FIG. 7C.

In the following reference will be made to FIGS. 7-10.

The clip 200 is a clip for a bracelet and/or a necklace. The clip in a closed state (as shown in FIGS. 7 and 10) have a through hole 202 allowing the clip 200 to wreathe an elongated member (such as a chain) of a bracelet and/or necklace. The through hole 202 defining a through hole axis 203 extending in an axial direction, with a radial direction extending radially from the axial direction. The clip 200 comprises a first part 220 and a second part 230, the first and second parts 220 230 being connected by a hinge 201. The clip 200 further comprise a first resilient element 250 arranged in the second part 230. The first resilient element 250 comprises a first gripping surface 251 for frictionally gripping a surface of the elongated member of a bracelet/necklace. The first resilient element 250 is spaced apart from the first part 220 i.e. the first resilient element 250 does not touch first part 220. The first part 220 comprises two rigid gripping surfaces 221 222 for gripping a surface of the elongated member. In this embodiment two rigid gripping surfaces 221 222 are two ridges arranged at the first and second opening of the through hole 202 respectively. The clip 200 according to the second embodiment is generally similar to the clip 100 according to the first embodiment (disclosed in relation to FIGS. 1-5). There are however two main differences: the outer shape of the clip 200 (being spherical) and the design of the first resilient element 250.

In this embodiment the first resilient element 250 has a third resilient part 280, the third resilient part 280 protruding from the first gripping surface 251, the third resilient part 280 having a third gripping surface 281 for gripping a surface of the elongated member. The first resilient element 250 has a fourth resilient part 290, the fourth resilient part 290 protruding from the gripping surface 251, the fourth resilient part 290 having a fourth gripping surface 282 for gripping a surface of the elongated member. By providing a first resilient element 250 having the third and fourth resilient parts 280 290 protruding from the first gripping surface 251, the clip 200 may be positioned on parts of the elongated member having different widths i.e. the first gripping surface 251 may enable the clip 200 to grip around parts of the elongated member having an extended width such as a band on the elongated member (as long as the length of the band is not larger than the distance 299 between the third resilient part 280 and the fourth resilient part 290), and the third and fourth gripping surface 281 282 may grip around the remaining parts of the elongated member. In this embodiment, the clip 200 comprises only one resilient element, i.e. the first resilient element. However, in other embodiments the clip 200 may comprise a second resilient element arranged in the first part 220 of the clip, where the second resilient element comprises a second gripping surface, and wherein the second resilient element has a third and fourth resilient part protruding from the second gripping surface, the third resilient part having a fifth gripping surface and the fourth resilient part having a sixth gripping surface, i.e. the second resilient element may have gripping surfaces corresponding to the gripping surfaces 251 281 282 of the first resilient element.

FIG. 11 shows schematically a bracelet/necklace 300 comprising an elongated member 301 and one or more clips 304-307 according to an embodiment of the present invention. The elongated member 301 comprises two bands 302 303 having an extended width compared with the width of the remaining parts of the elongated member 301. The clips 304-307 are only shown schematically. The clip disclosed in relation to FIGS. 1-5 may be secured to the elongated member only at the bands 302 303 or only at the remaining parts of the elongated member (unless the width of the bands only is slightly extended). Preferably, the clip disclosed in relation to FIGS. 1-5 is configured to be secured to the remaining parts of the elongated member. However, the clip disclosed in relation to FIGS. 7-10 may be secured to the elongated member both at the bands 302 303 and at the remaining parts of the elongated member as a result of the three gripping surfaces 251 281 282.

FIGS. 12-15 show a clip 400 according to a third embodiment of the present invention. FIG. 12A-b show the clip 400 assembled, where FIG. 12A shows a side view and FIG. 12B shows a top view.

FIGS. 13A-C show a second resilient element 495 of the clip 400, where FIG. 13A shows a perspective view, FIG. 13B shows a top view, and FIG. 13C shows a side view.

FIG. 14A shows an exploded view of a second part 430 of the clip 400, FIG. 14B shows an exploded view of a first part 420 of the clip 400, and FIG. 14C shows a perspective view of the second part 430 of the clip 400.

FIG. 15 shows a cross-section of the clip 400 along the line A shown in FIG. 12B.

In the following reference will be made to FIGS. 12-15.

The clip 400 is a clip for a bracelet and/or a necklace. The clip in a closed state (as shown in FIGS. 12 and 15) have a through hole 402 allowing the clip 400 to wreathe an elongated member (such as a chain) of a bracelet and/or necklace. The through hole 402 defining a through hole axis 403 extending in an axial direction, with a radial direction 404 extending radially from the axial direction. The clip 400 comprises a first part 420 and a second part 430, the first and second parts 420 430 being connected by a hinge 401. The clip 400 further comprise a first resilient element 450 arranged in the second part 130 and a second resilient element 495 arranged in the first part 420. The first resilient element 450 comprises a first gripping surface 451 and the second resilient element 495 comprises a second gripping surface 496 for frictionally gripping a surface of the elongated member of a bracelet/necklace. The first resilient element 450 is spaced apart from the first part 420 i.e. the first resilient element 450 does not touch the first part 420. The first resilient element 450 and the second resilient element allows said clip to be releasably secured at selected positions along the elongated member i.e. the first resilient element 450 and the second resilient element 495 together grips the elongated member and secures the clip 400 to the elongated member.

The clip may be forced to move along the elongated member, on which it is positioned by exerting a force in the axial direction, preferably using a hand.

In this embodiment the through hole is circular and the clip 400 have a cylindrical shape.

The first and second gripping surfaces 451 496 are smooth even surfaces.

The second part 430 comprises a cavity 440 extending in the radial direction 404, the first resilient element 450 comprises a first resilient part 460 arranged inside the cavity 440 and a second resilient part 470 arranged outside the cavity 440 and extending in the radial direction 104 from the cavity 140 into the through hole 402. The cavity 440 is configured to secure the first resilient element 450 in the second part 430.

Consequently, the first resilient element may be secured to the second part in an easy and secure manner. This further allows the first resilient element to be secured to the second part without the use of an adhesive, thereby protecting the user from coming into contact with potential harmful chemicals and increasing the aesthetic value of the ornamental component.

The cavity 440 is shaped so as to grip the first resilient part 460 and secure the first resilient element 450 in the second part 430.

The first resilient part 460 has a first outer surface 461 and the second resilient part 470 has a second outer surface 471, the first outer surface 461 and the second outer surface 471 extending at an angle with respect to each other.

The second part comprises a shell 431 having an outer surface 432 and an inner surface 433, the cavity 440 comprises a first side wall 441 and a second side wall 442 extending from the inner surface of the shell 433 of the second part 430, the first and second side wall 441 442 being configured to grip the first resilient part 460 and secure the first resilient element 450 in the second part 430 of the clip 400.

An air filled cavity 445 is formed between a bottom of the first resilient element 450 and a bottom of the cavity 440 at least when the first resilient element is in an un-compressed state, thereby allowing the resilient member 450 to expand further into the cavity 490 in response to a force exerted by an elongated member of a bracelet and/or necklace on the first gripping surface 451.

This may reduce the stress induced on the first resilient element 450 during normal use. Furthermore, it may limit the expansion of the first resilient element 450 in a direction along the through hole axis 403, thereby both securing that the first resilient element 450 is kept within the protective first and second parts 420 430 of the clip 400 and prevent the first resilient element 450 from being twisted out of the cavity 440.

The first part 420 comprises a cavity 443 extending in the radial direction 404, the second resilient element 495 comprises a first resilient part 498 arranged inside said cavity and a second resilient part 497 arranged outside the cavity 443 and extending in the radial direction 404 from the cavity 443. The cavity 443 is configured to secure the second resilient element 495 in the first part 420.

The cavity 443 is shaped so as to grip the first resilient part 498 and secure the second resilient element 495 in the first part 420.

An air filled cavity 499 is formed between a bottom of the second resilient element 495 and the bottom of the cavity 443 at least when the second resilient element 495 is in an un-compressed state. This allows the second resilient element 495 to expand further into the cavity 443 in response to a force exerted by an elongated member of a bracelet and/or necklace on the second gripping surface 496.

This may reduce the stress induced on the second resilient element during normal use.

The width 474 along the through hole axis 403 of the first part 498 of the second resilient element 495 is larger than the width 473 along the through hole axis 403 of the second part 497 of the second resilient element 495.

The first part 420 of the clip comprises two flanges 423 424 extending along the through hole axis 403 and being configured to grip the first part 498 of the second resilient element 495 and secure the second resilient element 495 in the first part 420 of the clip 400.

Consequently, the second resilient element 495 may effectively be secured to the first part 420 of the clip 400, while still providing room for arranging a closing element in the first part 420 of the clip 400.

The first part 420 comprises a closing element 406 for releasably securing the first 420 and the second part 430 to each other in the closed state of the clip 400. The second gripping element 495 is arranged on top of the closing element 406 and at least partly secures the closing element 406 to the first part 420.

The closing element 406 is a leaf spring arranged inside the first part 420, a part of the leaf spring extending out of the first part 420 and in a closed state of the clip extending into the second part 430.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A clip for a bracelet and/or a necklace, said clip in a closed state having a through hole allowing said clip to wreathe an elongated member of the bracelet and/or necklace, said through hole defining a through hole axis extending in an axial direction, with a radial direction extending radially from the axial direction, said clip comprising:

a first part and a second part, the first and second parts being connected by a hinge; and a first resilient element arranged in said second part, the first resilient element comprising a first gripping surface for frictionally gripping a surface of the elongated member;

wherein the second part comprises a cavity extending in the radial direction, the cavity extending in the axial direction between two sides of the second part, the two sides of the second part defining a portion of the through hole, the first resilient element comprising a first resilient part arranged inside said cavity and a second resilient part arranged outside said cavity and extending in the radial direction from said cavity into said through hole, wherein the cavity is shaped so as to grip the first resilient part and secure the first resilient element in said second part, and wherein the clip is configured to be movable along the elongated member, on which it is positioned by exerting a force in the axial direction.

2. A clip according to claim 1, wherein the first resilient element defines a height extending in the radial direction and a width along a reference axis being perpendicular to the radial direction and the through hole axis, where the maximum width of the first resilient part is larger than the maximum width of the second resilient part.

3. A clip according to claim 1, wherein the two sides are arranged to form edges of a shell, the shell having an outer surface and an inner surface, the cavity is further defined by two side walls extending from the inner surface of the shell of the second part, the two side walls being configured to grip the first resilient part and secure the first resilient element in said second part.

4. A clip according to claim 1, wherein an air filled cavity is formed between a bottom of the first resilient element and a bottom of the cavity at least when the first resilient element is in an un-compressed state, thereby allowing a resilient member to expand further into the cavity in response to a force exerted by the elongated member of the bracelet and/or necklace on the first gripping surface.

5. A clip according to claim 1, wherein the first resilient element has a third resilient part, the third resilient part protruding from the first gripping surface, the third resilient part having a third gripping surface for gripping a surface of the elongated member, whereby the clip may be releasably secured to parts of the elongated member having different widths.

6. A clip according to claim 5, wherein the first resilient element has a fourth resilient part, the fourth resilient part protruding from the first gripping surface, the fourth resilient part having a fourth gripping surface for gripping a surface of the elongated member.

7. A clip according to claim 1, wherein said clip further comprises a second resilient element arranged in said first part, the second resilient element comprising a second gripping surface for frictionally gripping a surface of the elongated member, wherein the first resilient element and the second resilient element allows said clip to be releasably secured at selected positions along the elongated member.

8. A clip according to claim 7, wherein the first part comprises a cavity extending in the radial direction, the second resilient element comprises a first resilient part arranged inside said cavity and a second resilient part arranged outside said cavity and extending in the radial direction from said cavity, wherein the cavity is configured to secure the second resilient element in said first part.

9. A clip according to claim 7, wherein the first part comprises a closing element for releasably securing the first and the second part to each other in said closed state of the clip, wherein the second gripping element is arranged on top of the closing element and at least partly secures the closing element to the first part.

10. A clip according to claim 7, wherein the width along the through hole axis of the first part of the second resilient element is larger than the width along the through hole axis of the second part of the second resilient element.

11. A clip according to claim 10, wherein the first part of the clip comprises two flanges extending along the through hole axis and being configured to grip the first part of the second resilient element and secure the second resilient element in said first part of the clip.

12. A clip according to claim 1, wherein the first part comprises a rigid second gripping surface for gripping a surface of the elongated member, and the first resilient element and the rigid second gripping surface allow said clip to be releasably secured at selected positions along the elongated member.

13. The clip of claim 1, wherein, when the clip is in the closed state, the first resilient element in both a relaxed or uncompressed state and in a compressed state is spaced apart from the first part.

14. The clip of claim 13, wherein, when the clip comprises a second resilient element, the first resilient element in both the relaxed or uncompressed state and in the compressed state is spaced apart from the second resilient element when the clip is in the closed state.

15. A bracelet or a necklace comprising:

an elongated member; and a clip configured to be releasably secured at selected positions along at least a part of the elongated member, said clip in a closed state having a through hole allowing said clip to wreathe the elongated member of the bracelet or necklace, said through hole defining a through hole axis extending in an axial direction, with a radial direction extending radially from the axial direction, said clip comprising:

a first part and a second part, the first and second parts being connected by a hinge; and a first resilient element arranged in said second part, the first resilient element comprising a first gripping surface for frictionally gripping a surface of the elongated member;

wherein the second part comprises a cavity extending in the radial direction, the cavity extending in the axial direction between two side walls of the second part, the two side walls of the second part defining a portion of the through hole and being parallel to each other, the first resilient element comprising a first resilient part arranged inside said cavity and a second resilient part arranged outside said cavity and extending in the radial direction from said cavity into said through hole, wherein the cavity is configured to secure the first resilient element in said second part, and wherein the clip is configured to be movable along the elongated member, on which it is positioned by exerting a force in the axial direction.

16. The bracelet or necklace of claim 15, wherein, when the clip is in the closed state, the first resilient element in both a relaxed or uncompressed state and in a compressed state is spaced apart from the first part.

17. The bracelet or necklace of claim 16, wherein, when the clip comprises a second resilient element, the first resilient element in both the relaxed or uncompressed state and in the compressed state is spaced apart from the second resilient element when the clip is in the closed state.

18. A method for assembly of a clip, said clip in a closed state having a through hole allowing said clip to wreathe an elongated member of a bracelet and/or necklace, said through hole defining a through hole axis extending in an axial direction, with a radial direction extending radially from the axial direction, comprising:

providing a first part and a second part of the clip, the first and second parts being connectable by a hinge, wherein the second part comprises a cavity extending in the radial direction, the cavity extending in the axial direction between two sides of the second part, the two sides of the second part defining a portion of the through hole;

providing a first resilient element comprising a first gripping surface for frictionally gripping a surface of the elongated member, a first resilient part and a second resilient part; and inserting the first resilient element in the cavity of said second part so that the first resilient part is arranged inside said cavity and the second resilient part is arranged outside said cavity and extends in the radial direction from said cavity into said through hole, wherein the clip is configured to be movable along the elongated member, on which it is positioned by exerting a force in the axial direction.

19. The method of claim 18, wherein, when the clip is in the closed state, the first resilient element in both a relaxed or uncompressed state and in a compressed state is spaced apart from the first part.

20. The method of claim 19, wherein, when the clip comprises a second resilient element, the first resilient element in both the relaxed or uncompressed state and in the compressed state is spaced apart from the second resilient element when the clip is in the closed state.

* * * * *